US006501220B1

(12) United States Patent
Lambrechts et al.

(10) Patent No.: US 6,501,220 B1
(45) Date of Patent: Dec. 31, 2002

(54) THALLIUM FREE—METAL HALIDE LAMP WITH MAGNESIUM AND CERIUM HALIDE FILLING FOR IMPROVED DIMMING PROPERTIES

(75) Inventors: Stefaan Lambrechts, Beverly Farms, MA (US); Jakob Maya, Brookline, MA (US)

(73) Assignee: Matushita Research and Development Laboraties Inc, Woburn, MA (US)

( * ) Notice: Subject to any disclaimer, the term of this patent is extended or adjusted under 35 U.S.C. 154(b) by 245 days.

(21) Appl. No.: 09/691,509

(22) Filed: Oct. 18, 2000

(51) Int. Cl.[7] ..... H01J 17/20
(52) U.S. Cl. ..... 313/571; 313/637
(58) Field of Search ..... 313/567, 571, 313/637, 638, 639, 640

*Primary Examiner*—Vip Patel

(57) ABSTRACT

A thallium-free high pressure ceramic metal halide lamp having superior dimming characteristics with a fill composition comprising $MgI_2$ and $CeI_3$. In addition, the fill chemistry comprises NaI and the halides of rare earth metals such as Dy, Ho and Tm.

5 Claims, 6 Drawing Sheets

LPW
90
85
80
75
70
65
60
55
50
45
40
150
130
110
90
75
WATTS [W]
THALLIUM IODIDE SUBSTITUTED WITH CERIUM - AND MAGNESIUM IODIDE (WEIGHT OF FILL = 1X MG)
THALLIUM IODIDE SUBSTITUTED WITH CERIUM - AND MAGNESIUM IODIDE (WEIGHT OF FILL = 2X MG)
150 WATT PANABEAM LAMP FROM MEC COMPRISING THALLIUM IODIDE

THALLIUM IODIDE SUBSTITUTED WITH CERIUM - AND MAGNESIUM IODIDE (WEIGHT OF FILL = 1X MG
THALLIUM IODIDE SUBSTITUTED WITH CERIUM - AND MAGNESIUM IODIDE (WEIGHT OF FILL = 2X MG
150 WATT PANABEAM LAMP FROM MEC COMPRISING THALLIUM IODIDE
WATTS [W]
150
130
110
90
75
CCT [K]
5400
5200
5000
4800
4600
4400
4200
4000

CRI [-]
100
90
80
70
60
50
40
Watts [W]
150
130
110
90
75
THALLIUM IODIDE SUBSTITUTED WITH CERIUM - AND MAGNESIUM IODIDE (WEIGHT OF FILL = 1X MG
THALLIUM IODIDE SUBSTITUTED WITH CERIUM - AND MAGNESIUM IODIDE (WEIGHT OF FILL = 2X MG
150 WATT PANABEAM LAMP FROM MEC COMPRISING THALLIUM IODIDE THALLIUM IODIDE SUBSTITUTED WITH CERIUM - AND MAGNESIUM IODIDE (WEIGHT OF FILL = 1X MG
THALLIUM IODIDE SUBSTITUTED WITH CERIUM - AND MAGNESIUM IODIDE (WEIGHT OF FILL = 2X MG
150 WATT PANABEAM LAMP FROM MEC COMPRISING THALLIUM IODIDE
Duv [-]
20
18
16
14
12
10
8
6
4
2
0
150
130
110
90
75
WATTS [W]

THALLIUM FREE— METAL HALIDE LAMP WITH MAGNESIUM AND CERIUM HALIDE FILLING FOR IMPROVED DIMMING PROPERTIES

TECHNICAL FIELD

This invention relates to the dimming of high intensity discharge lamps in particular to low wattage ceramic metal halide lamps. Traditionally, the rare earth spectra of these lamps are composed of thulium, praseodymium, neodymium, lutetium, gadolinium, terbium, dysprosium, holmium, erbium emitters. In addition, sodium and thallium iodide and mercury are added to the fill chemistry. These lamps are designed to have a specific color temperature (CCT), a high color rendering index (CRI) and a high efficacy (LPW) at rated power. However, at reduced power levels as low as 50%, the photometric performance deteriorates substantially.

BACKGROUND OF THE INVENTION

There is a need for metal halide lamps with good dimming properties. Discharge lamps with rare earth chemistry are very popular because of their excellent color quality and high luminous output. Such lamps perform very well at rated power, however at reduced power levels, their photometric performance is rather poor. In the case of dimming as low as 50%, it is very desirable that the metal halide lamps produce white light with minimum color change and efficacy loss. To achieve effective dimming, the CCT, $D_{uv}$ and CRI should remain unchanged. There should only be little loss of efficacy.

Typically, the light of commercial metal halide lamps that contain thallium iodide (TlI) for high efficacy turns from a white at rated power to a greenish color under dimming conditions. In addition, the efficacy of these lamps decreases significantly. The metal halide TlI is highly desired because of its high vapor pressure and its strong green radiation at 535 nm. However under dimming conditions, the partial pressure of thallium tends to dominate, in turn, causing a shift of the light color to a greenish hue.

Therefore, the objective of this invention is to provide a metal halide lamp that at rated power gives excellent CCT, CRI, Duv and efficacy. A further objective is to provide a lamp that when dimmed to as low as 50% power maintains its color temperature and white hue. Still a further objective of the present invention is to provide a metal halide lamp that when dimmed retains substantially good CCT, CRI, $D_{uv}$ and efficacy, as close to rated power performance as possible. Yet another objective of the present invention is to provide a new chemistry for ceramic metal halide lamps that are electrically retrofitable in existing fixtures.

DESCRIPTION OF RELATED PRIOR ART

Metal halide lamps comprising rare earth iodides have high luminous output and excellent color properties. Their spectrum consists of multiple lines of atomic and molecular radiation. The composition of the fill chemistry of a particular type is optimized at rated power without taking into account the performance at reduced power levels. When these metal halide lamps are dimmed for energy saving purposes, their photometric performance degrades significantly. Especially, lamps containing thallium iodide exhibit a strong greenish hue under dimming condition. For 150 W lamps in particular, the color temperature increases from 4339 K at 150 W to about 5285 K at 75 W. The $D_{uv}$ increases more than 17 points and the CRI drops from 95 at 150 W to 69 at 50% power. The efficacy drops from 80 lpw at rated power to 61 lpw at 50% power.

U.S. patent application Ser. No. 09/627,842 filed Jul. 28, 2000, by Zhu et al., having the same assignee, describes a thallium free metal halide lamp with magnesium halide ($MgI_2$) filling for improved dimming properties. The invention relates to ceramic metal halide lamps with metal halide materials such as NaI, $DyI_3$, $HoI_3$ and $TmI_3$. The substitution of TlI with $MgI_2$ greatly improves the color properties at lower than rated power levels.

The rare earth material cerium iodide ($CeI_3$) has been used in U.S. Pat. No. 5,973,453 from Van Vliet et al., particularly in relation with NaI. The metal halide lamps of this patent are obtained with a high luminescent efficacy. However, these lamps are not suitable for dimming and have rather poor color properties at rated and reduced power. $CeI_3$ was also used in the U.S. Pat. No. 3,786,297 from Zollweg et al. to produce lamps with high efficacy.

SUMMARY OF THE INVENTION

Figure 1:
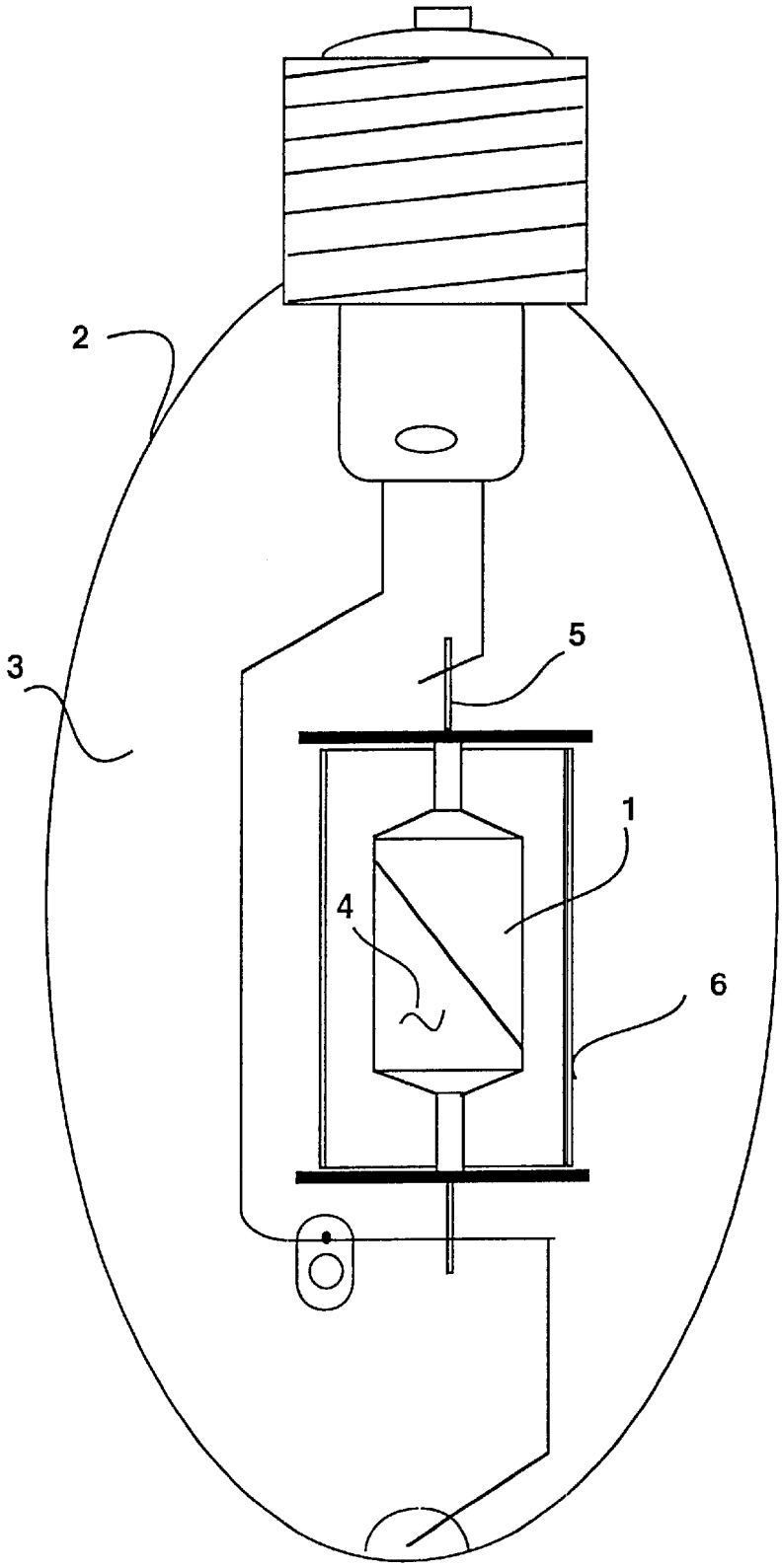
FIG. 1 depicts a lamp construction according to this invention.

It is the object of this invention to make a ceramic metal halide lamp that provides nearly constant color and high efficacy under dimming conditions. The lamp provides high efficacy, constant color temperature, high CRI and excellent Duv at rated and reduced power as low as 50%. The color coordinates x, y are very close to the blackbody locus at rated and at 50% power. The excellent dimming properties were achieved by substituting the thallium iodide (TlI) with magnesium iodide ($MgI_2$) and cerium iodide ($CeI_3$). $MgI_2$ has relatively high vapor pressure at operational temperatures and has emission lines at 517.2 and 518.3 nm. As opposed to TlI, its variation of vapor pressure with temperature is very much like the iodides of the rare earth elements such as dysprosium, holmium and thulium. The radiation spectrum of cerium is broadband and the shape of this spectrum is little effected under dimmed conditions. The cerium spectrum consists of an abundance of lines covering the entire visible spectrum with a large concentration at about 550 nm (Journal of IES, July 1975- R. J. Zollweg, C. S. Liu, C. Hirayama and J. W. Mc. Nall). Substituting TlI with the combination of $CeI_3$ and $MgI_2$ the metal halide lamp in particular remains white under dimming conditions as low as 50%. Moreover, the efficacy remains relatively high during dimming. The basic objective requires the elimination of thallium iodide to achieve better color performance throughout the dimming. Using halides, preferably iodides and/or bromides, and the addition of $MgI_2$ and $CeI_3$ provides lamps with constant color as they are dimmed. Depending on the wall loading and the fill amount of the metal halides, it is possible with $MgI_2$ and $CeI_3$ to create a gas discharge with a color temperature of about 4300 K. Moreover, the color temperature remains constant at 4300±100 K throughout the dimming. $MgI_2$ has a relatively high vapor pressure and emission lines at 517.2 and 518.3 nm. Its radiation is very close to the peak of the human eye sensitivity curve resulting in high lumen output at rated and reduced power. The spectrum of $CeI_3$ exhibits a broadband emission with a maximum emission at about 550 nm. The shape of the broadband spectrum remains very much unchanged at various power levels.

The vapor pressure of TlI is relatively high and remains relatively high with decreasing cold spot temperature. Typically, TlI at rated power is unsaturated and depending on the dimming level it remains unsaturated in the gas phase while the rare earths collapse due to decreasing temperature while dimming. TlI tends to dominate the lamp spectrum at powers lower than rated power and adversely affects the color properties of the lamp. As opposed to TlI, the vapor pressures of $MgI_2$ and $CeI_3$ gradually decrease with decreasing cold spot temperature and this variation is similar to the rare earth halides such as $DyI_3$, $HoI_3$ and $TmI_3$ The combination of $MgI_2$ and constant CCT, high CRI, low $D_{uv}$ and high efficacy when dimmed.

The lamps in the present invention have an outer jacket filled with nitrogen at 350 torr and this makes these lamps less susceptible to catastrophic failure during life.

Another advantage is that the construction is the same as the commercial lamps. As shown in FIG. 1, the arc tube 1, which can be tapered or cylindrical, is made of polycrystalline alumina (PCA) and is housed in an outer jacket 2 of hard glass. The outer jacket volume 3 may be evacuated or filled with an inert gas such as 350 Torr of nitrogen. The arc tube is dosed with the halides 4 of sodium, cerium, magnesium, thulium, dysprosium and holmium. The lamp current is conducted by means of feed through assemblies 5 that are hermetically sealed to the alumina arc tube. A shroud 6 is made of hard glass.

Figure 2:
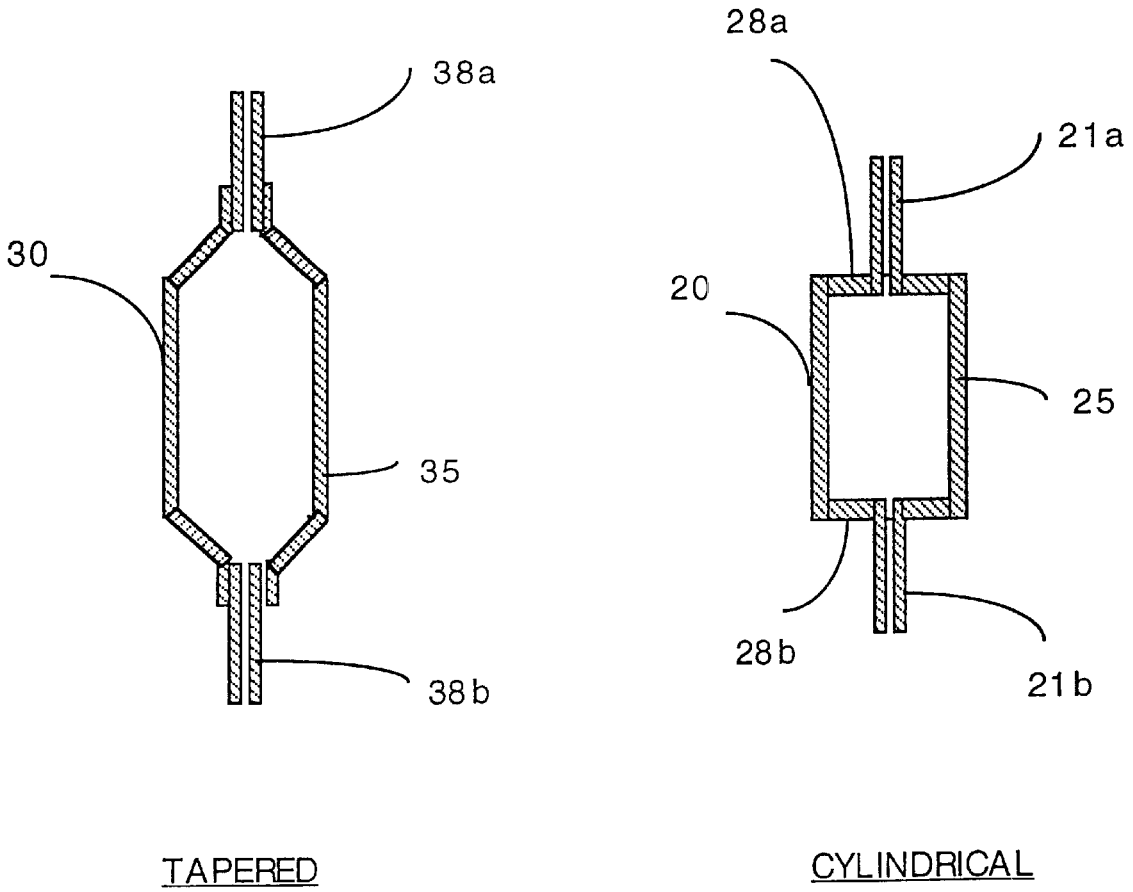
FIG. 2 shows the two arc tube shapes that were used in this invention.

FIG. 2 shows the 150 W cylindrical and tapered discharge tube configurations discussed in this invention. For the cylindrical arc tube, the discharge tube 20 consists of a cylindrical main tube 25, a first disk 28*a* and a second disk 28*b*. Cylindrical narrow tubes 21*a* and 21*b* are attached to the first disk and the second disk by shrinkage fitting.

The main tube, the disks and the narrow tubes are made of translucent ceramic material in which alumina is a main ingredient. The tapered discharge tube 30 consists of three parts; a tapered main tube 35 and two narrow tubes 38*a* and 38*b* at the opposite ends. All these parts are made of translucent ceramic material in which alumina is a main ingredient.

DESCRIPTION OF PREFERRED EMBODIMENTS

Figure 3:
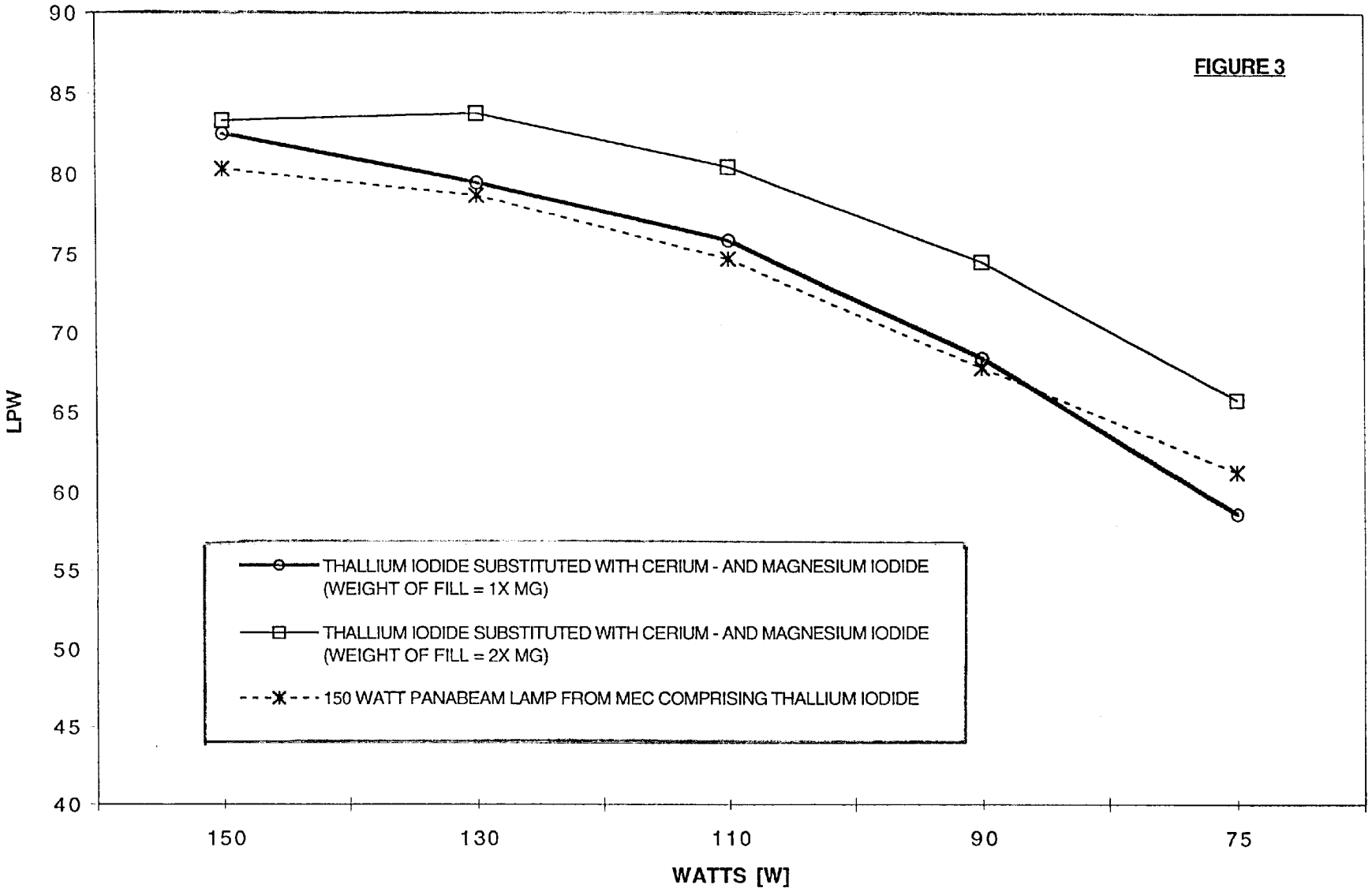
FIG. 3 shows the efficacy of two 150 W tapered ceramic lamps of this invention and a prior art 150 W lamp aged for 100 hours at various power levels. The weight of the fill chemistry of the two lamps of this invention is 1x and 2x mg.
Figure 4:
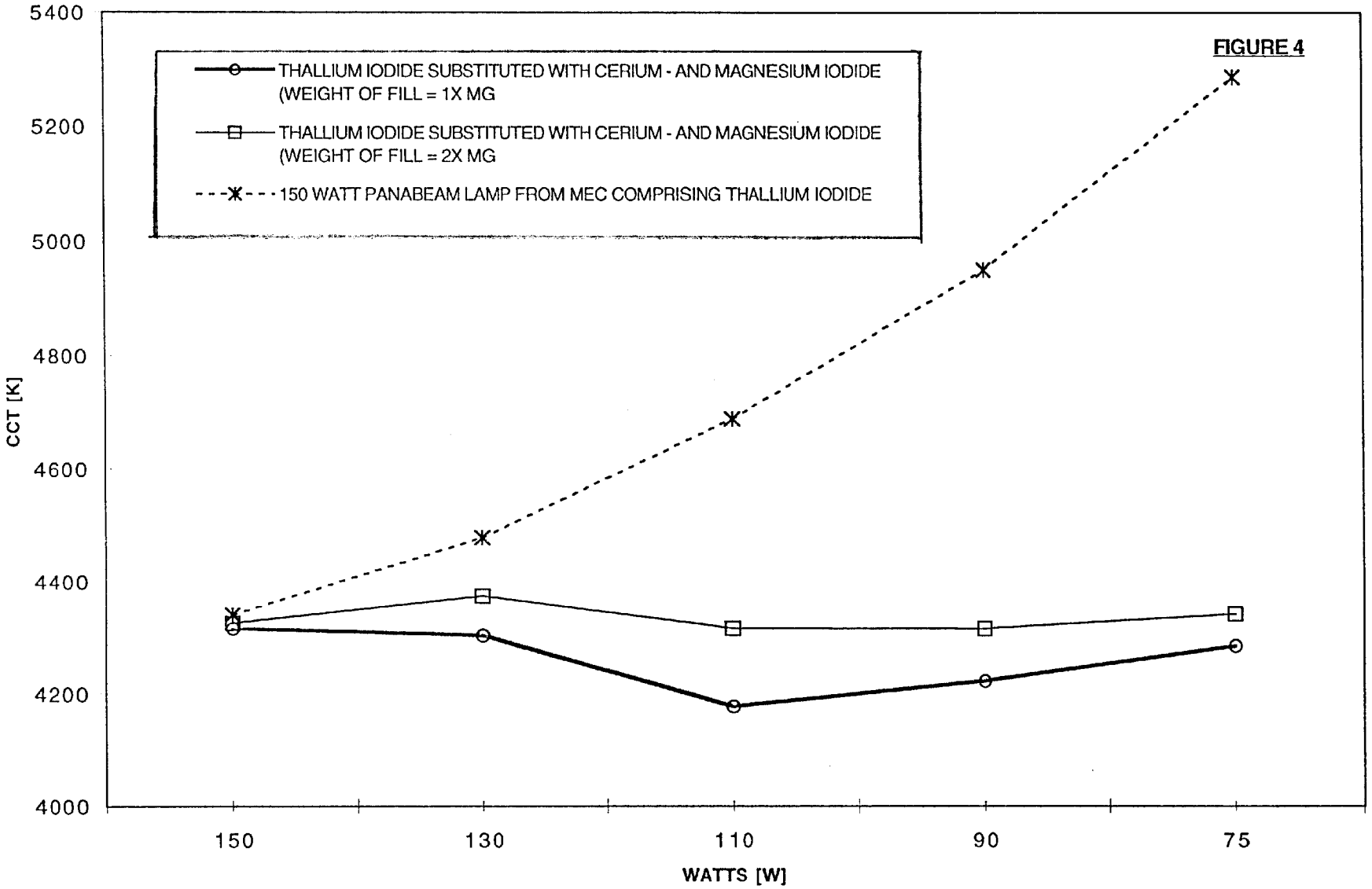
FIG. 4 shows the color temperature of the same lamps and the prior art lamp aged for 100 hours at various power levels.
Figure 5:
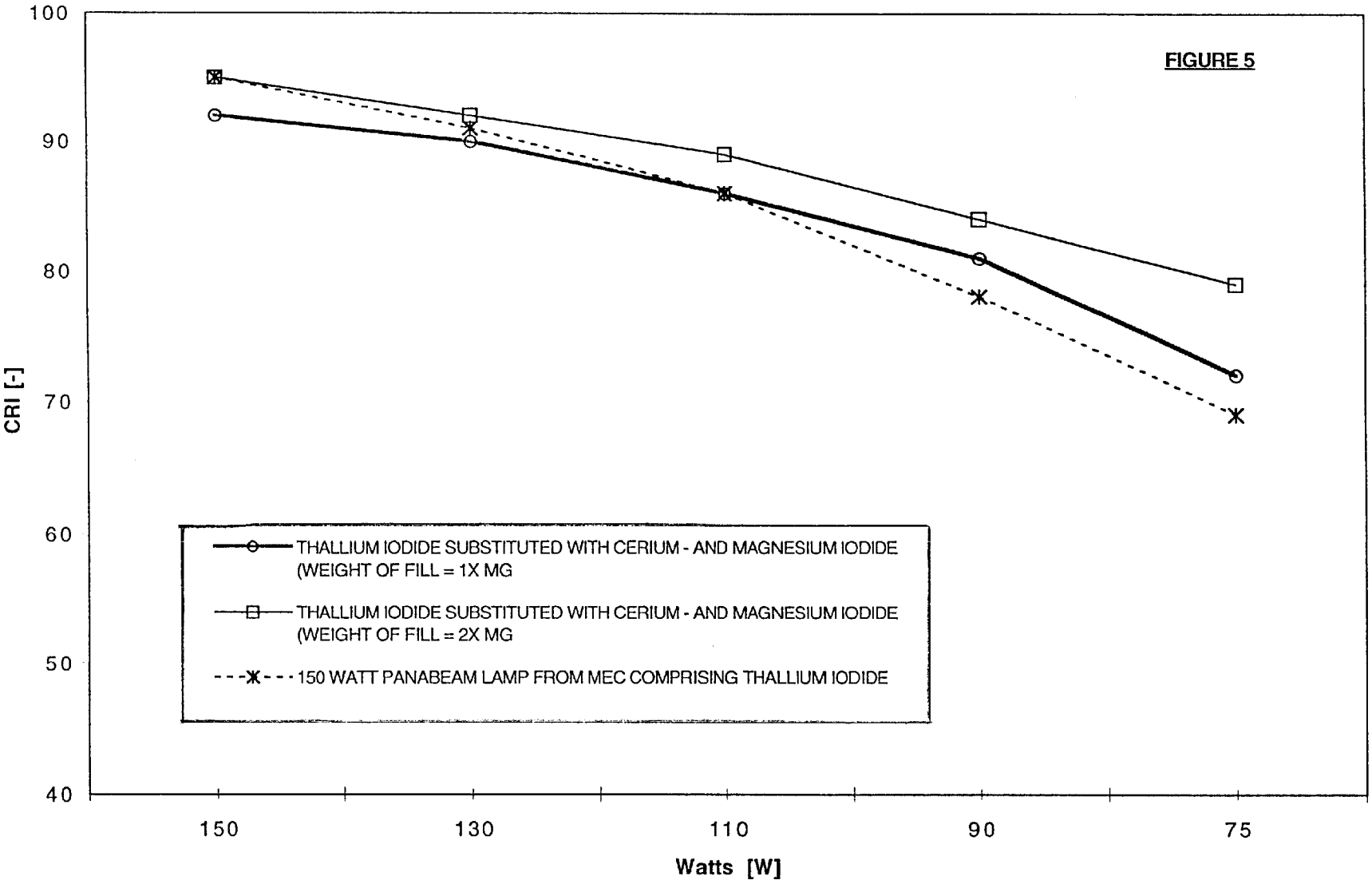
FIG. 5 shows the color rendering index of the same lamps and the prior art lamp aged for 100 hours at various power levels.

The lamps of this invention are made of polycrystalline alumina. The lamps in particular are 150 W ceramic metal halide lamps with a filling of 5.6 mg of the metal halides NaI, $CeI_3$ $MgI_2$, $DyI_3$, $HoI_3$ and $TmI_3$. The arc tube contains about 9.3 mg of Hg yielding about 95 volts. In addition, the filling comprises Ar or Xe ignition gas with a pressure of about 160 mbar. FIGS. 3, 4, 5 and 6 show the results of a lamp of the present invention with 5.6 mg fill chemistry compared with a 4300 K commercial metal halide lamp. The lamps were 150 W metal halide lamps and were burned in a vertical base up position. FIG. 3. depicts the efficacy of the lamps and it can be seen that the efficacy of the lamps are very similar. FIG. 4 compares the color temperatures (CCT) and it can be noted that the change of CCT for the lamp according to this invention is only about 135 K and close to the 4300 K specification during the dimming condition. FIG. 5 depicts the CRI when the lamps are dimmed. The lamp according to this invention has better color rendering properties at reduced power levels compared with the commercial 150 W ceramic metal halide lamp.

Figure 6:
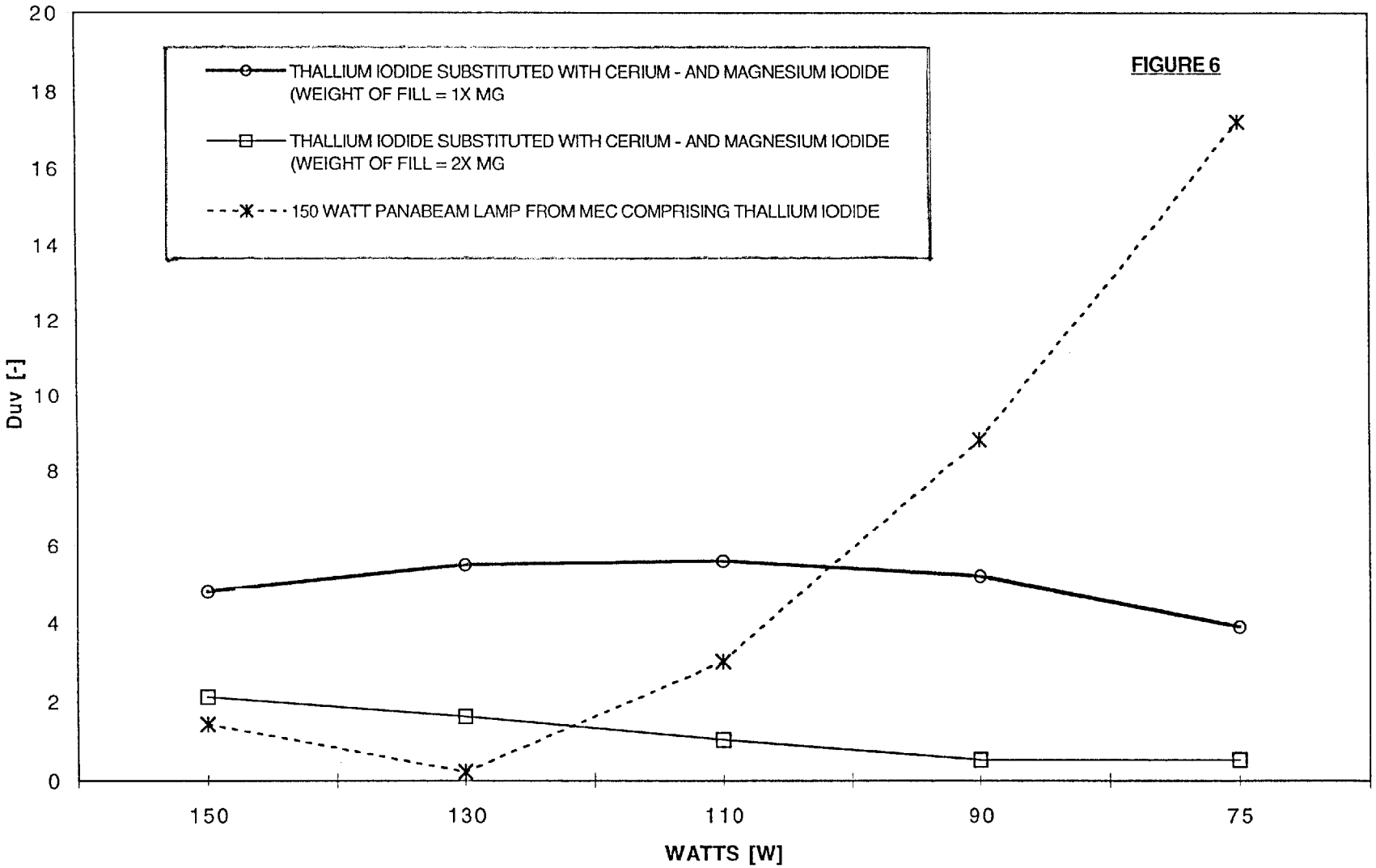
FIG. 6 shows the $D_{uv}$ of the same lamps and the prior art lamp aged for 100 hours at various power levels.

FIG. 6 shows the $D_{uv}$ of the lamps when they are dimmed. The $D_{uv}$ of the lamp according to this invention is around 5. At 150 W, the color points x=0.3651 and y=0.3568 for $D_{uv}$=4.8 are near the blackbody curve and the lamp looked generally white at rated and reduced power levels.

Similarly, good dimming properties were achieved when substituting TlI with $MgI_2$ and $CeI_3$ and increasing the amount of fill chemistry from 5.6 to 12 mg. In particular, the filling of the discharge vessel was about 9.6 mg of Hg and 12 mg of the metal halides NaI, $MgI_2$ $CeI_3$, $DyI_3$, $HoI_3$ and $TmI_3$. The arc tube comprises Ar or Xe as an ignition gas with a pressure of about 160 mbar. At saturated vapor, the remaining salts will condense in the cooler area of the ceramic arc tube. When overdosing the lamp, part of the remaining salts will condense in warmer areas and in this way increase the number of particles in the vapor phase. It was found experimentally, that for the particular fill composition the photometric properties improved during dimming. In FIGS. 3, 4, 5 and 6 we compare the performance of a tapered shaped arc tube with 12 mg fill chemistry with the performance of a commercial lamp. The lamps were 150 W metal halide lamps and were burned in the vertical base up position. FIG. 3 depicts the efficacy of the lamps and it can be seen that the efficacy of the lamp according to this invention is somewhat better at rated and reduced power. FIG. 4 compares the color temperatures (CCT) and it can be noted very well that the color temperature of the lamp according to this invention is nearly constant at 4300 K during dimming condition. FIG. 5 depicts the CRI when the lamps are dimmed. The lamp according to this invention has excellent color rendering properties compared with a commercial 150 W ceramic metal halide lamp with a CCT of 4300 K. FIG. 6 shows the $D_{uv}$ of the lamps when they are dimmed. The $D_{uv}$ of the lamp according to this invention is smaller than 2.1 and is nearly constant. At 150 W, the color points x=0.3683 and y=0.3732 for $D_{uv}$=2.1 are near the blackbody curve and the lamp looked generally white at rated and reduced power levels.

In this invention, it was found experimentally that the tapered arc tube performed slightly better than the cylindrical arc tube. This is probably attributed to the higher cold spot temperature of the tapered arc tube.

It is apparent that modifications and changes may be made within the spirit and scope of the present invention, but it is our intention only to be limited by the following claims.

As our invention, we claim:

1. A thallium free metal halide lamp of different wattages having superior dimming characteristics said lamp comprising:

a discharge vessel formed of a transparent material resistant to sodium at high temperature and discharge electrodes positioned at opposite ends within the discharge vessel;

a thallium free chemical fill including mercury and metal halides in said vessel, said fill including at least $MgI_2$ and $CeI_3$; and an outer jacket surrounding the discharge vessel.

2. The lamp according to claim 1 in which the ionizable filling comprises Hg with Ar or Xe, the halides of Na and at least one of the rare earths metal of Dy, Ho and Tm and wherein $MgI_2$ and $CeI_3$ are in a molar quantity between 1.5% and 65% of the total quantity of the total halides.

3. A lamp according to claim 1 wherein the metal halides are of Na, Dy, Ho and Tm and where such halides are iodides or bromides.

4. The lamp according to claim 1 wherein the vessel is formed of polycrystalline alumina.

5. A thallium free metal halide lamp of different wattages having superior dimming characteristics said lamp comprising:

a discharge vessel formed of polycrystalline alumina, resistant to sodium at high temperature and discharge electrodes positioned at opposite ends within the discharge vessel;

an ionizable filling comprising Hg with Ar or Xe, the halides of Na and at least one of the rare earths metal of Dy, Ho and Tm and wherein $MgI_2$ and $CeI_3$ are in a molar quantity between 1.5% and 65% of the total quantity of the total halides and an outer jacket surrounding the discharge vessel.

* * * * *